US005758636A

United States Patent [19]

Butrimas et al.

[11] Patent Number: 5,758,636

[45] Date of Patent: Jun. 2, 1998

[54] SAFETY GUARD FOR STOVES

[76] Inventors: Victor Butrimas, 33 Davisville Avenue, PH11, Toronto, Ontario, Canada, M4S 2Y9; Donald LeClair, 6 McCallum Ct., Brampton, Ontario, Canada, L6W 2R6

[21] Appl. No.: 538,452

[22] Filed: Oct. 3, 1995

[51] Int. Cl.[6] ..... F24C 15/10; F24C 3/12

[52] U.S. Cl. ..... 126/211; 126/42; 126/214 D; 126/201; 126/221; 126/220

[58] Field of Search ..... 126/42, 211, 214 D, 126/201, 221, 220

[56] References Cited

U.S. PATENT DOCUMENTS

| | | | |
|---|---|---|---|
| 2,772,414 | 11/1956 | Baker, Jr. | 126/24 X |
| 3,898,975 | 8/1975 | Kemp | 126/42 |
| 4,155,343 | 5/1979 | Hartman | 126/211 |
| 4,157,705 | 6/1979 | Caan | 126/214 D X |
| 4,517,955 | 5/1985 | Ehrlich et al. | 126/211 X |
| 5,076,255 | 12/1991 | Harrison | 126/42 |
| 5,377,660 | 1/1995 | Bombardier | 126/42 |
| 5,450,840 | 9/1995 | Kozdas | 126/42 |

FOREIGN PATENT DOCUMENTS

| | | | |
|---|---|---|---|
| 2113826 | 8/1983 | United Kingdom | 126/214 C |

*Primary Examiner*—Larry Jones

[57] ABSTRACT

The present invention provides for a guard for surrounding the exposed perimeter of the top of a domestic stove. The guard is releasably attached to the stove top such that when it is attached to the stove it securely encloses the burners and pots resting on the burners. The guard prevents the passage of a finger through the guard such that a person is prevented from contacting the burner or pots on the stove when the guard is attached to the stove.

12 Claims, 3 Drawing Sheets

SAFETY GUARD FOR STOVES

FIELD OF THE INVENTION

The present invention relates to a guard for use on domestic gas and electric stoves to reduce the incidence of injury around the stove.

BACKGROUND OF THE INVENTION

One of the areas of a household that is highest in incidence of injuries is the kitchen. Many such injuries in the kitchen arise from burning or scalding caused by accidental contact with a domestic stove or with spillage of food products being heated on the stove. There have been stove guards developed in the past, such as that for example sold through Mothercare Stores in England for a number of years. Such guards however do not provide complete protection from the dangers of burning or scalding from the stove. Some such designs such as that sold through the Mothercare Stores have a relatively open wire frame work through which a toddler or other young child may pass their hand such that they may still contact either the burner of the stove or pots or contents of the pots being heated on the stove. There remains a need for a stove guard which will protect especially small toddlers from the dangers of burns or scalds and which is easy to attach and detach from the stove.

SUMMARY OF THE INVENTION

The present invention provides for a guard for surrounding the exposed perimeter of the top of a domestic stove. The guard is releasably attached to the stove top such that when it is attached to the stove it securely encloses the burners and pots resting on the burners. The guard prevents the passage of a finger through the guard such that a person is prevented from contacting the burner or pots on the stove when the guard is attached to the stove.

BRIEF DESCRIPTION OF THE DRAWINGS

Preferred embodiments of the present invention are illustrated in the attached drawings, in which.

DETAILED DESCRIPTION OF THE PREFERRED EMBODIMENTS

Figure 1:
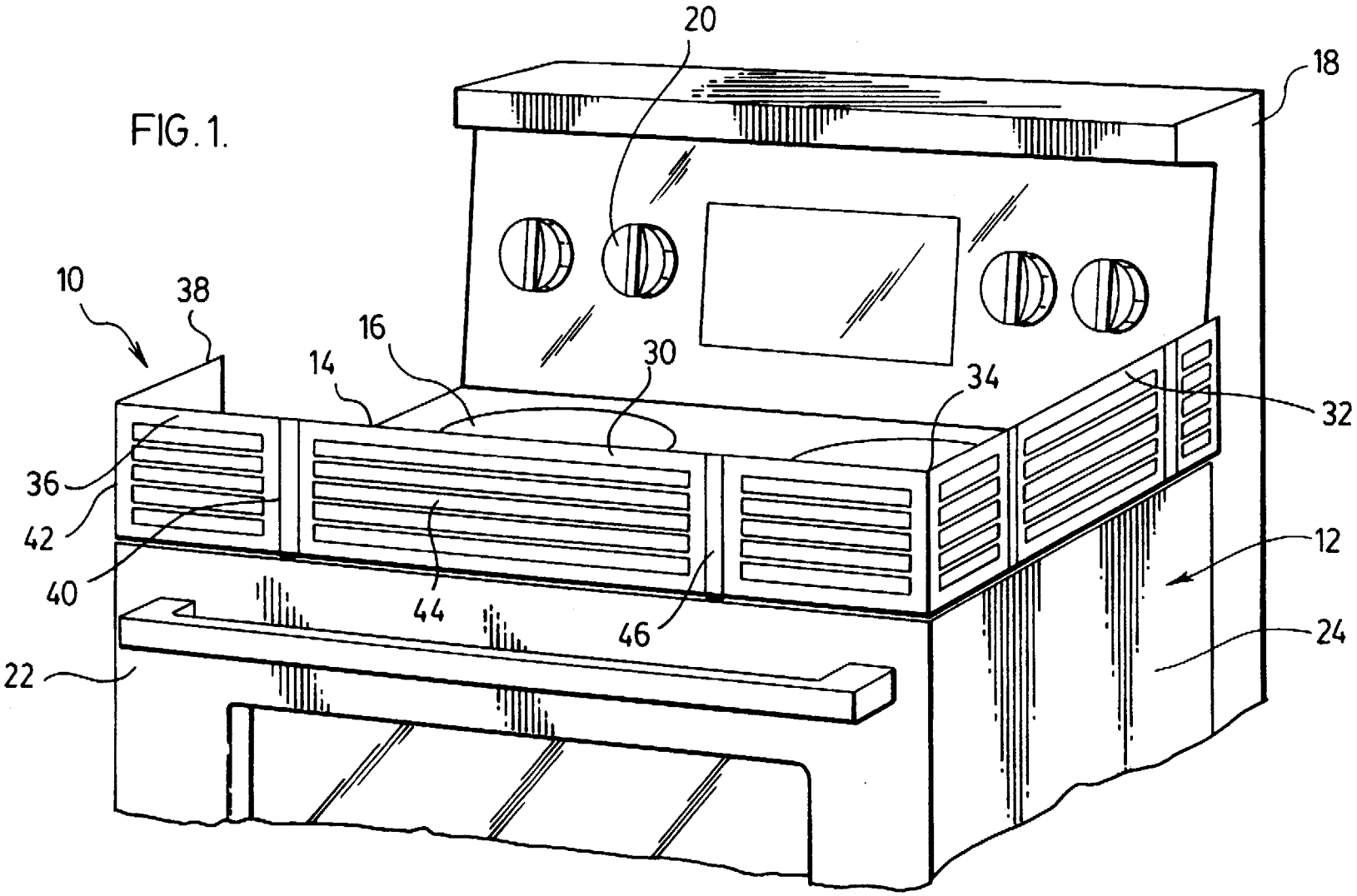
FIG. 1 is a perspective view of a domestic stove having the stove guard of the present invention attached thereto.
Figure 2:
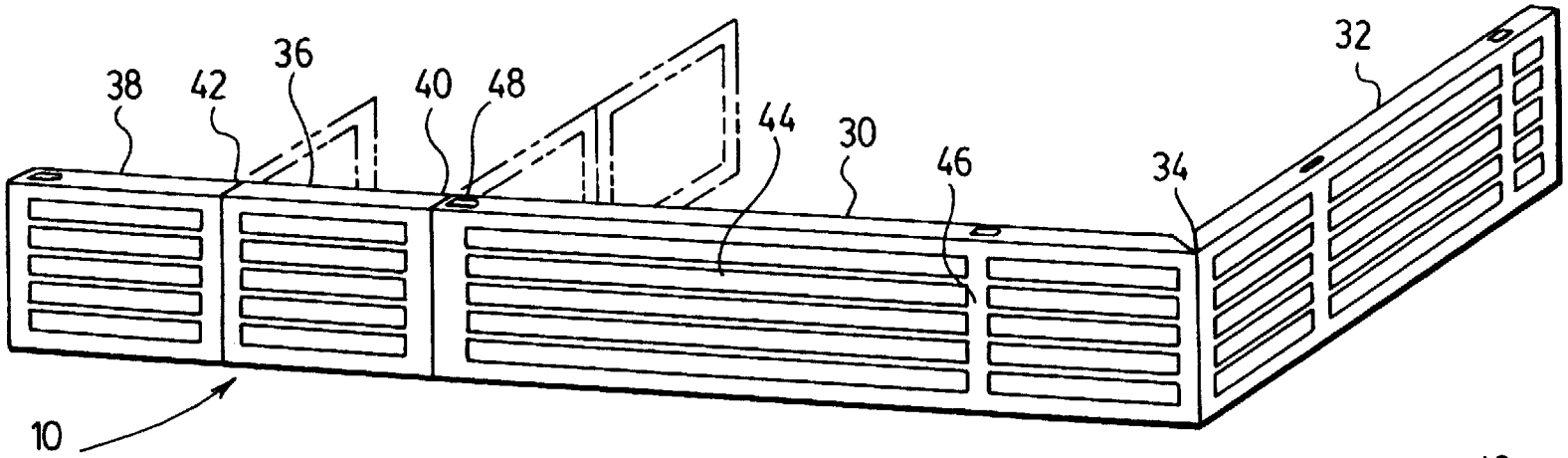
FIG. 2 is a front perspective view of the stove guard of FIG. 1.

FIG. 1 illustrates the stove guard of the present invention generally indicated by the numeral 10 attached to a domestic electric stove 12. While the figures illustrate the stove guard 10 attached to a electric stove 12, the stove guard 10 is also suitable for use with gas stoves.

A typical gas or electric domestic stove 12 has a stove top 14 containing burners 16 and generally has an upright control panel 18 which contains the controls 20 for the operation of the burners 16 and the oven. The oven is located below the stove top 14 enclosed within an oven casing 24 and is accessed through an oven door 22.

Figure 3:
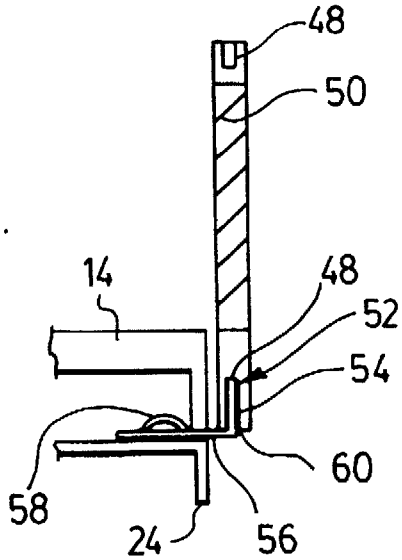
FIG. 3 is a side view in cross section of the louvered vents and the attachment of the stove guard of FIG. 1 to a stove.

FIG. 3 illustrates in further detail the stove guard of the preferred embodiment of the present invention. Stove guard

10 is constructed of a suitable plastic or metal which will resist the effects of the heat from the burners 16 of the stove 12. The stove guard 10 has a front section 30 and a first side section 32 attached to one end of the front section 30 through a living hinge 34. Attached to the other end of the front section 30 are second and third extensions 36 and 38 respectively attached to the front section 30 and each other by means of living hinges 40 and 42. Front section 30 and first side section 32 have louvered regions 44 separated by upright section 46. Similarly, second and third side sections 36 and 38 are provided with louvred regions. In one embodiment, the top and bottom of the front section 30, and first side section 32 in the region of the upright sections 46 and third side section 38 at the end are provided with openings 48 for insertion of attachment brackets as will be explained further below.

Figure 5:
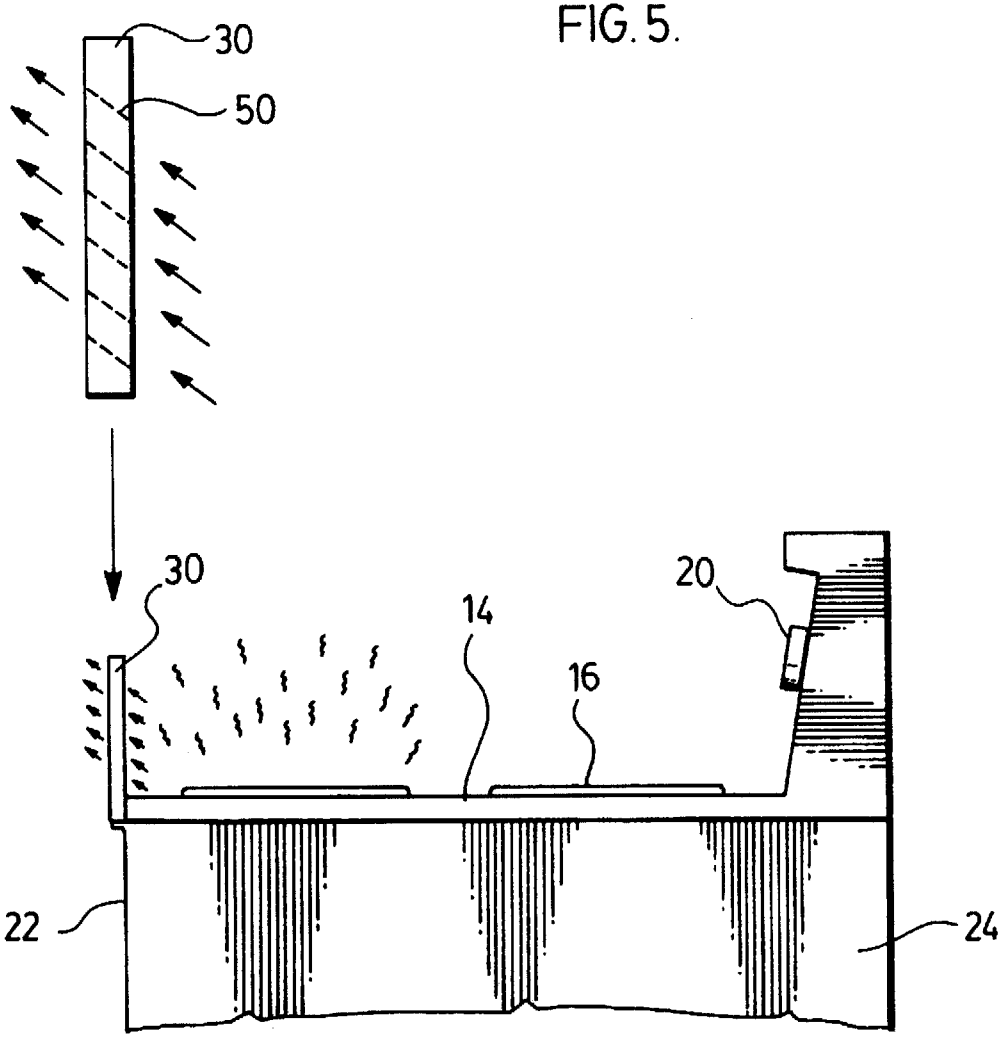
FIG. 5 is a side elevation view of the operation of the stove guard of FIG. 1 when attached to a stove.

The louvered sections 44 are designed such that airflow through the stove guard is maintained aiding in the ventilation of the steam and heat from the cooking while preventing passage of a person's fingers or hands through the stove guard. As illustrated in particular in FIG. 5, preferably these louvers 50 in the louvered sections 44 are slanted upwardly and outwardly with respect to the front of the stove guard 10. This arrangement of the louvres 50 results in air flowing from the interior of the stove guard 10 through the louvres in an outwardly upwardly manner. This air flow helps maintain a cool temperature of the guard even when in close proximity tot the burners and prevents hot steam or other cooking fluids from spilling over the stove top 14 and potentially burning or scalding a person. Due to the direction of air flow through the louvres, such hot steam and other cooking fluids are directed upwardly from the pots and away from the edges of the stove top 14. It has been found that with the close spacing of the louvres of the preferred embodiment, if the louvres are arranged upwardly and inwardly, then heat from the burners tends to become trapped in the area between the guard and burner and is not dissipated as well as if the louvres are arranged upwardly and outwardly.

Figure 4:
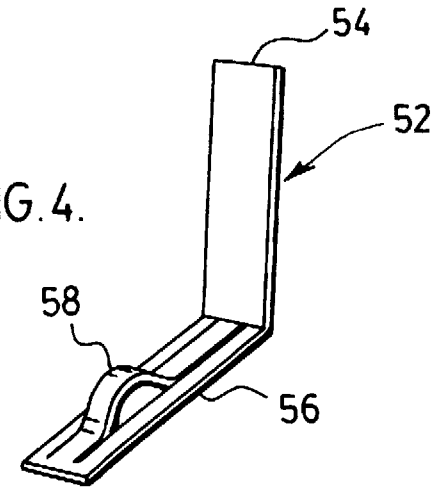
FIG. 4 is an illustration of the attachment bracket for attachment of the stove guard of FIG. 1 to a stove.

As illustrated in FIG. 3, in one embodiment, the stove guard 10 is attached to the stove top 14 by means of suitable attachment brackets 52. Preferably such brackets 52 as shown in FIG. 4 are L-shaped brackets having an upright section 54 which fits within the opening 48 in the upright sections of the front 30, first side extension 32 and third side extension 38 of the stove guard 10. The lower leg 56 of the L-shaped bracket 52 is designed to slip within the opening between the stove top 14 and the oven casing 24. Preferably, to allow for secure engagement of the leg 56 of the L brackets 52 and hence the stove guard 10 with the stove 12, leg 56 is provided with a releasable securing means 58 which is illustrated in the drawings as a resiliently deformable extension which is pushed downwardly during the insertion of the leg 56 into the opening between the stove top 14 and the oven casing and when it is past the lip of the stove top 14, returns to the initial position providing for secure engagement of the bracket 52 and hence the stove guard 10 to the stove top 14. Releasable securing means 58 may be provided with a release extension lever 60 which may be pressed downwardly to allow for easy removal of the bracket 52 and hence the stove guard 10 from the stove 12 for either cleaning of the stove 12 or for those situations when the stove guard 10 may not be required.

The provision of second and third extensions 36 and 38 connected to one another and to the front section 30 of the stove guard by means of living hinges 40 and 42 allows the stove guard 10 of the present invention to be easily adapted to various sizes of stoves 12. At the present time in North America, the two most commonly sized stoves are the apartment stoves which are generally 24 inches in width and standard stoves which are generally 30 inches in width.

The embodiments of the invention in which an exclusive property or privilege is claimed are defined as follows:

1. A stove guard for surrounding the of the top of a domestic stove having a stove top containing burners, the stove guard comprising a front and at least one side section to surround the exposed perimeter of the stove top the front and side sections being hingedly connected to one another by means of a living hinge, the guard being releasable attached to the stove top by a releasable attachment means such that when it is attached to the stove it surrounds the exposed perimeter of the stove and securely encloses the burners and pots resting on the burners, the stove guard being provided with releasable attachment means at both the top and the bottom such that the orientation of the stove guard may be reversed, the front and side sections being provided with louvred regions to allow air passage through the guard while preventing passage of a finger between the louvres such that a person is prevented from contacting a burner or a pot on a burner when the guard is attached to the stove.

2. A stove guard as claimed in claim 1 wherein the guard further includes at least one side extension attached to a second end of the front section by means of a living hinge.

3. A stove guard as claimed in claim 1 wherein the guard further includes two side extensions attached to the second end of the front section by means of a living hinge and having a further living hinge attaching the side extensions to one another.

4. A stove guard as claimed in claim 1 wherein the releasable attachment means comprises openings at the top and bottom of the stove guard for accepting a first leg of an L-shaped attachment bracket, a second leg of the bracket being insertable between a stove top and an oven casing of a stove.

5. A stove guard as claimed in claim 4 wherein the second leg of the bracket includes a releasable securing means for securing the second leg in the opening between a stove top and an oven casing of a domestic stove.

6. A stove guard as claimed in claim 1 wherein the louvred regions have the louvres oriented in an upwardly outwardly direction.

7. The combination of a domestic stove having a stove top containing burners and a stove guard attached to the exposed regions of the stove top, the stove guard comprising a front and at least one side section to surround the exposed perimeter of the stove top, the front and side sections being hingedly connected to one another by means of a living hinge, the guard being releasably attached to the stove top by a releasable attachment means such that it surrounds the exposed perimeter of the stove and securely encloses the burners and pots resting on the burners, the stove guard being provided with releasable attachment means at both the top and the bottom such that the orientation of the stove guard when attached to the stove may be reversed to cover the exposed front and side of the perimeter of the stove top, the front and side sections being provided with louvred regions to allow air passage through the guard while preventing passage of a finger between the louvres such that a person is prevented from contacting a burner or a pot on a burner when the guard is attached to the stove.

8. The combination of claim 7 wherein the stove guard further includes at least one side extension attached to a second end of the front section by means of a living hinge.

9. The combination of claim 7 wherein the stove guard further includes two side extensions attached to the second end of the front section by means of a living hinge and having a further living hinge attaching the side extensions to one another.

10. The combination of claim 7 wherein the releasable attachment means comprises openings at the top and bottom of the stove guard for accepting a first leg of an L-shaped attachment bracket, a second leg of the bracket being insertable between the stove top and an oven casing of the stove.

11. The combination of claim 10 wherein the second leg of the attachment bracket includes a releasable securing means for securing the second leg in the opening between the stove top and the oven casing.

12. The combination of claim 7 wherein the louvred regions have the louvres oriented in an upwardly outwardly direction from the stove top.

* * * * *